US007810802B2

(12) United States Patent
Kishimoto et al.

(10) Patent No.: US 7,810,802 B2
(45) Date of Patent: Oct. 12, 2010

(54) ROLLER AND SHEET FEEDING APPARATUS

(75) Inventors: Fumimitsu Kishimoto, Toride (JP); Tomoo Akaba, Toride (JP); Shimpei Kogawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 345 days.

(21) Appl. No.: 11/945,707

(22) Filed: Nov. 27, 2007

(65) Prior Publication Data

US 2008/0128972 A1 Jun. 5, 2008

(30) Foreign Application Priority Data

Dec. 4, 2006 (JP) ..... 2006-327527

(51) Int. Cl.
*B65H 3/52* (2006.01)

(52) U.S. Cl. ..... 271/122; 271/109

(58) Field of Classification Search ..... 271/122, 271/125, 109; 492/47

See application file for complete search history.

(56) References Cited

U.S. PATENT DOCUMENTS 5,996,990 A * 12/1999 Kawashima ..... 271/122

FOREIGN PATENT DOCUMENTS

| | | |
|---|---|---|
| JP | 7-269589 | 10/1995 |
| JP | 7-301248 | 11/1995 |
| JP | 8-26513 | 1/1996 |
| JP | 11-349167 | 12/1999 |
| WO | WO 2004/002718 | 1/2004 |

OTHER PUBLICATIONS

Korean Official Action dated Jul. 21, 2009.

* cited by examiner

*Primary Examiner*—Richard W Ridley
*Assistant Examiner*—Michael C McCullough
(74) *Attorney, Agent, or Firm*—Fitzpatrick, Cella, Harper & Scinto

(57) ABSTRACT

The sheet conveying roller includes a shaft member and a sliding portion arranged in the circumferential direction of the shaft member. The sliding portion is adapted to make sliding contact with the shaft member. The sheet conveying roller also includes an elastic member configured to fasten the sliding portion to the shaft member and makes contact with a conveyed sheet at an outer circumference thereof. The elastic member generates a frictional resistance between the shaft member and the sliding portion by a clamping force of the elastic member.

5 Claims, 10 Drawing Sheets

ROLLER AND SHEET FEEDING APPARATUS

BACKGROUND OF THE INVENTION

1. Field of the Invention

The present invention relates to a sheet conveying roller and a sheet feeding apparatus.

2. Description of the Related Art

Conventionally, image forming apparatuses such as printers, copier or facsimiles, or image reading apparatuses are provided with a sheet feeding apparatus to separate a plurality of recording papers or documents (hereinafter, simply referred to as a sheet) that is stacked in a sheet storage unit and feed out the separated sheets to an image forming section or an image reading unit on a one-by-one basis.

The sheet feeding apparatus includes a sheet separation unit for separating sheets one by one. Japanese Patent Application Laid-Open No. H07-301248 discusses a structure employing a separation roller as the sheet separation unit. The separation roller uses a separation pad and functions as a torque limiter. In such a sheet separation unit, a separation roller having a torque limiter connected on the same shaft or incorporated therein is brought into pressure-contact with a feed roller, separating sheets by the braking torque of the torque limiter.

For example, when only one sheet is nipped by the feed roller and the separation roller, a large rotation torque is applied to the torque limiter, allowing the separation roller to rotate following the rotation of the feed roller. Such rotation of the separation roller following the rotation of the feed roller will be referred to as accompanied rotation. On the other hand, when a plurality of sheets is placed between the feed roller and the separation roller, a relatively small rotation torque is applied to the torque limiter, suppressing accompanied rotation of the separation roller with the feed roller. In this way, by suppressing the accompanied rotation of the separation roller with the feed roller, the feed roller can convey only one sheet at a time while the separation roller prevents two or more sheets from being conveyed at the same time.

That is, when a plurality of sheets is nipped by the feed roller and the separation roller, the braking torque of the torque limiter decreases to a lower limit so as to suppress the accompanied rotation. On the other hand, when only one sheet is placed between the feed roller and the separation roller, the braking torque of the torque limiter increases to an upper limit so as to allow the accompanied rotation. By controlling the braking torque within the above-described range, the sheet separation function and the sheet feeding capability can be properly provided.

Such a structure is known to be capable of provide a stable sheet feeding operation while maintaining excellent durability and preventing the pad and sheet from making a fluttering sound compared with a structure having a sheet separation unit employing a separation pad. A typical torque limiter usable in such a sheet feeding apparatus is equipped with powder clutches or brakes and a coil spring.

As illustrated in FIG. 11, the conventional sheet feeding apparatus includes a separation roller 16*a* connected to a torque limiter 16*b* so as to be rotatably held on a separation roller support member 16*c* along with the torque limiter 16*b*. Referring to FIG. 11, the separation roller 16*a* is brought into pressure contact with a feed roller (not illustrated) by means of a spring 16*d*.

Connection between the separation roller 16*a* and the torque limiter 16*b* is not limited to such a manner. As illustrated in FIG. 12A, the torque limiter 16*b* may be connected to the separation roller 16*a* so as to be substantially incorporated into the separation roller 16*a*. Incidentally, a structure as illustrated in FIG. 12B can be used as a means for retarding rotation that applies a driving force in a direction opposite to a sheet conveying direction to a separation roller. Referring to FIG. 12B, a torque limiter 17*b* is fixed to a driving shaft 17*c* of a separation roller 17*a* so that the separation roller 17*a* and the torque limiter 17*b* are connected to each other on the same shaft.

The above-described torque limiters 16*b* and 17*b* need to be configured as a separate structure. Since the torque limiters 16*b* and 17*b* are connected on the same shaft as the separation rollers 16*a* and 17*a*, or are incorporated into the separation rollers 16*a* and 17*a*, a combined structure is not symmetric in the longitudinal direction, increasing the overall size and production cost of a sheet feeding apparatus. As described above, the conventional sheet feeding apparatus employing the above-described torque limiter cannot be produced in a small size and at a low cost.

In addition, since a sheet conveying path for feeding out a sheet is not symmetric in the longitudinal direction, the leading end of the sheet is blocked midway in the sheet conveying path, or the sheet conveying operation is not properly performed due to the difference of conveying resistance on the left and right sides of the sheet conveying path. Therefore, it is necessary to devise means for guiding sheets such as a sheet guiding surface or wall.

Japanese Patent Application Laid-Open No. H08-026513 describes a torque limiter in which a tubular friction member is fixed on the outer circumference of a rotary member, and a tubular member is fitted to the outer surface of the rotary member. A plurality of sliding members is fitted to the friction member through a window portion of the tubular member. The plurality of sliding members is brought into pressure contact with the outer circumferential surface of the friction member by a spring member. Japanese Patent Application Laid-Open No. H07-269589 describes a torque limiter in which a main body member is fitted to a member for outputting power through a friction member, and a twisted-coil spring is applied to the outside of the power outputting member to fasten the power outputting member. The power outputting member is provided with a cylindrical fitting portion having a coil spring installed on the outer circumference. In the fitting portion, a plurality of slit groove portions are formed which extends in the axial direction from a flange portion and is opened at one end thereof.

The structures discussed in Japanese Patent Application Laid-Open Nos. H08-026513 and H07-269589 are difficult to produce in a small size and at a low cost because the torque limiter is configured as a separate structure independent from that of a sheet conveying roller.

SUMMARY OF THE INVENTION

The present invention is directed to a roller that can be produced in a small size and at a low cost.

The present invention is also directed to a sheet feeding apparatus enabling a stable sheet feeding operation, which can be produced in a small size and at a low cost.

According to a first aspect of the present invention, there is provided a sheet conveying roller including: a shaft portion; a sliding portion arranged on a circumferential surface of the shaft member, the sliding portion being adapted to make sliding contact with the shaft portion; an elastic member configured to fasten the sliding portion to the shaft member and making contact with a conveyed sheet at an outer circumference thereof, wherein the elastic member generates a frictional resistance between the shaft portion and the sliding portion by a clamping force of the elastic member.

According to a second aspect of the present invention, there is provided a sheet feeding apparatus including: a sheet stacking portion on which sheets are stacked; a sheet conveying rotating member that conveys the sheets stacked on the sheet stacking portion; a shaft portion; a sliding portion arranged on the circumferential surface of the shaft portion, the sliding portion being adapted to make sliding contact with the shaft portion; a separation rotating member formed of an elastic member and configured to fasten the sliding portion to the shaft member, the separation rotating member separates a plurality of sheets nipped by the sheet conveying rotating member and the separation rotating member, wherein a frictional resistance is generated between the shaft portion and the sliding portion by the clamping force of the separation rotating member formed of the elastic member.

Further features of the present invention will become apparent from the following description of exemplary embodiments with reference to the attached drawings.

DESCRIPTION OF THE EMBODIMENTS

Exemplary embodiments of the present invention will now be described in detail with reference to the attached drawings.

Figure 1:
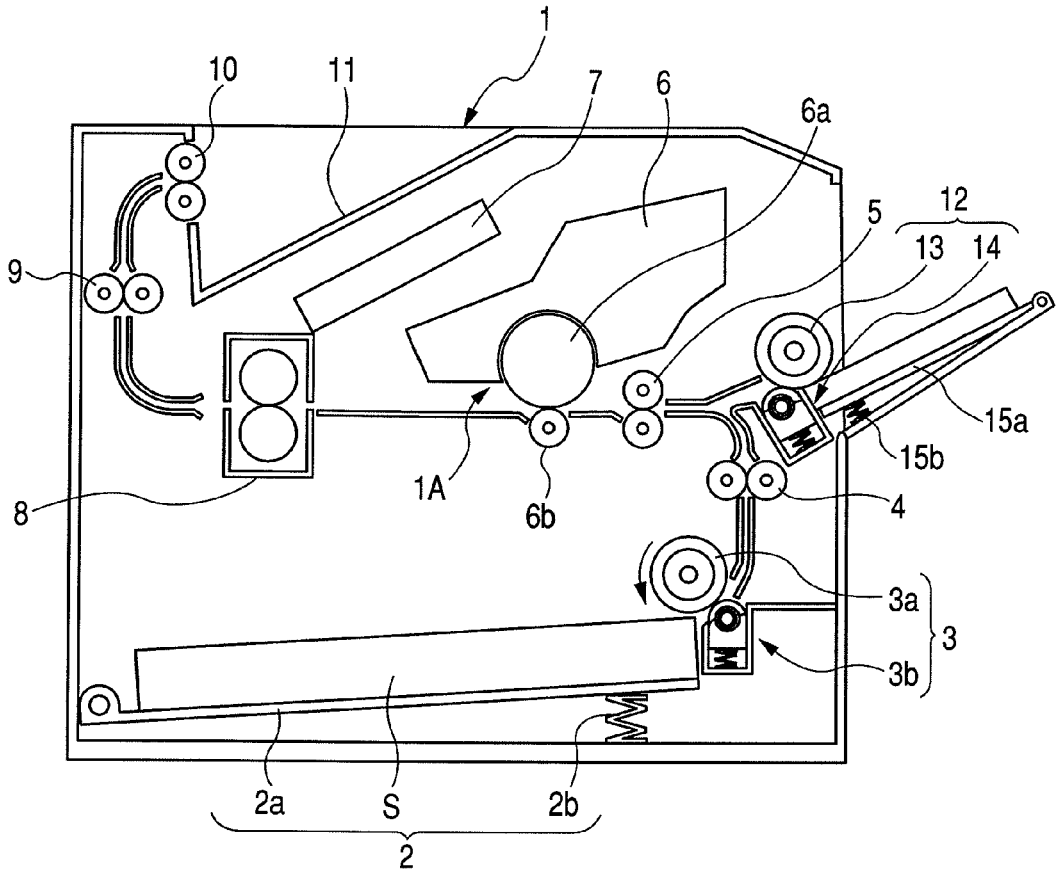
FIG. 1 is a schematic diagram illustrating an electrophotographic printer as an example of an image forming apparatus including a sheet feeding apparatus according to a first embodiment of the present invention.

FIG. 1 is a schematic diagram illustrating an electrophotographic printer as an example of an image forming apparatus including a sheet feeding apparatus according to a first embodiment of the present invention. The size, material, shape, relative position, and other features of each component described in the embodiments do not limit the scope of the invention unless otherwise specified.

A printer main body (hereinafter, referred to as an apparatus main body) 1 and an image forming section 1A are illustrated in FIG. 1. The image forming section 1A includes a laser scanner 7, an image forming process unit 6 having a photosensitive drum 6*a* as an image bearing member, and a transfer roller 6*b* that transfers toner images formed on the photosensitive drum 6*a* onto a sheet S.

When the toner images formed by the image forming section 1A are transferred onto a sheet, the toner images transferred onto the sheet are fixed by a fixing device 8. Then, the sheet S having the toner images fixed thereon is sequentially discharged to and stacked on a discharge tray 11 provided on an uppermost portion of the apparatus main body.

Figure 2:
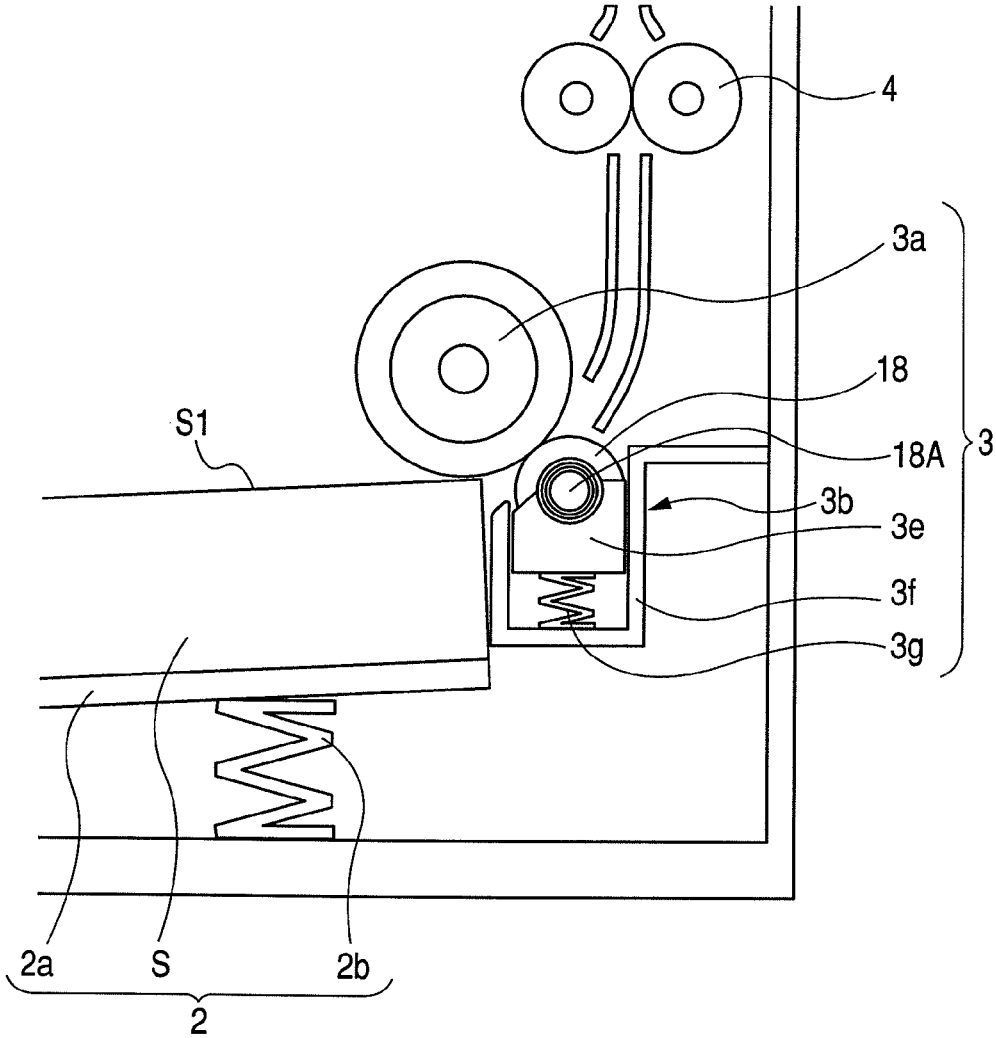
FIG. 2 is a diagram illustrating the structure of the sheet feeding apparatus according to the first embodiment.

A sheet feeding apparatus 3 is provided on a lower portion of the image forming section 1A. As illustrated in FIG. 2, the sheet feeding apparatus 3 includes a sheet-feeding cassette 2 as a sheet storage unit and a feed roller 3*a* that delivers sheets S stored in the sheet-feeding cassette 2. The sheet feeding apparatus 3 also includes a sheet separation portion 3*b*. The sheet separation portion 3*b* is provided with a separation roller 18 that makes pressure contact with the feed roller 3*a* as a sheet conveying roller, and is configured to separate the sheets S fed out from the feed roller 3*a* one by one.

Figure 9:
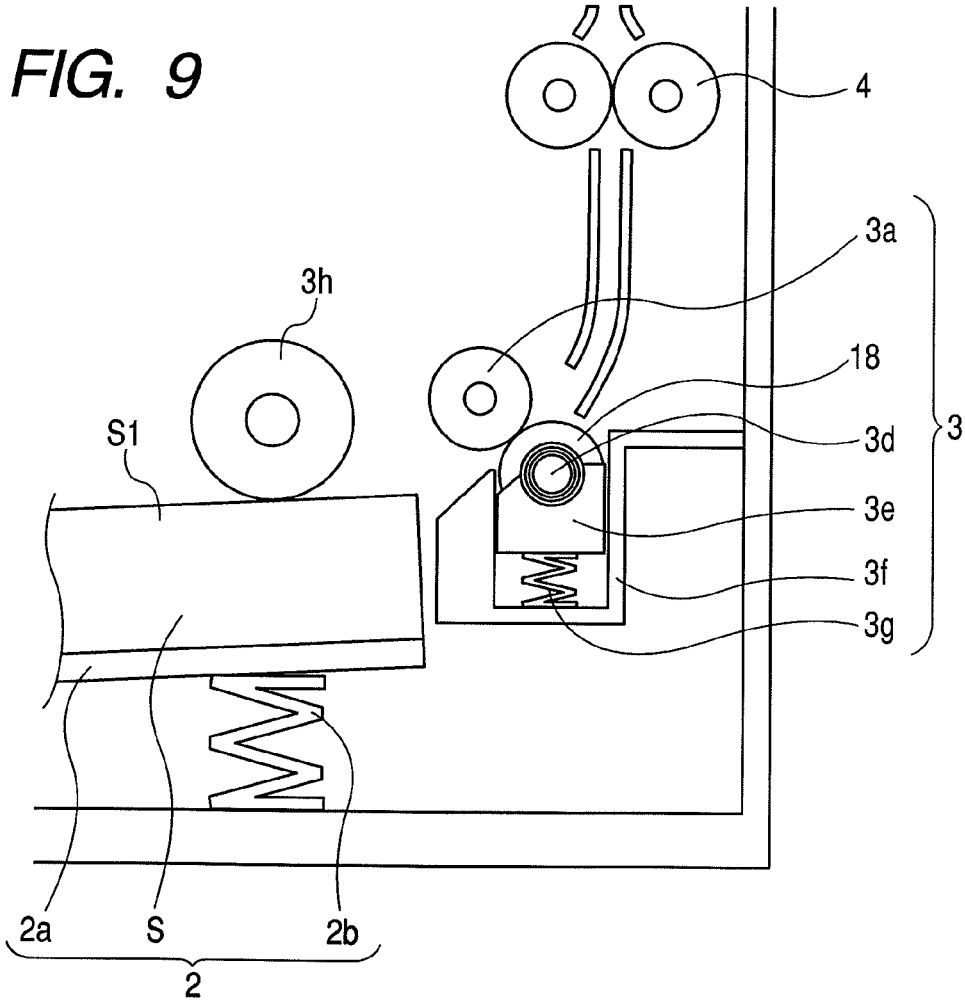
FIG. 9 is a diagram illustrating the structure of the sheet feeding apparatus according to a first modification.

The feed roller 3*a* also functions as a pickup roller which will be described later and corresponds to a sheet feeding unit illustrated in FIG. 9, and is rotatably provided to the sheet-feeding cassette 2. The feed roller 3*a* makes contact with an uppermost sheet S1 stacked on a sheet stacking plate 2*a* that stores the sheets S, and also makes contact with the separation roller 18 on the downstream side in the sheet conveying direction. The sheet stacking plate 2*a* is pressed upward by a pressure spring 2*b* from a back surface side (downside in FIG. 2) of the sheet stacking plate 2*a* so that a leading end of the uppermost sheet S1 stacked on the sheet stacking plate 2*a* is pressed against the feed roller 3*a*.

In a printer equipped with the sheet feeding apparatus 3 having such a structure, as the feed roller 3*a* rotates counterclockwise as illustrated in FIGS. 1 and 2 by being driven by a drive motor (not illustrated), the uppermost sheet S1 stacked on the sheet stacking plate 2*a* is delivered. After this, the uppermost sheet S1 is separated from other sheets by the sheet separation portion 3*b* and is conveyed to the downstream side.

Figure 3:
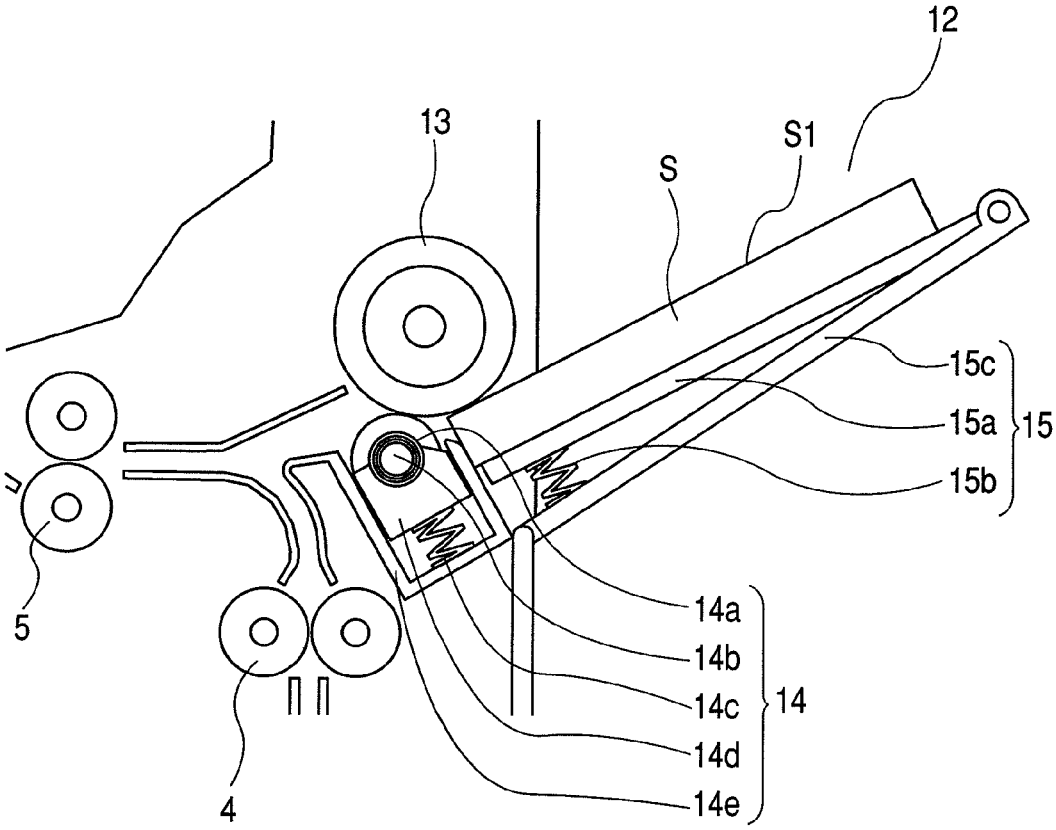
FIG. 3 is a diagram illustrating the structure of a multiple-sheet feeding apparatus as an example of the sheet feeding apparatus according to the first embodiment.

As illustrated in FIG. 1, a multiple-sheet feeding section 1 as an example of a sheet feeding apparatus is provided on a lateral portion of the image forming section 1A. As illustrated in FIG. 3, the multiple-sheet feeding section 12 includes a sheet stacking plate 15*a* and a feed roller 13 as a sheet feeding unit that delivers sheets S stacked on the sheet stacking plate 15*a*. The multiple-sheet feeding section 12 also includes a sheet separation portion 14. The sheet separation portion 14 is provided with a separation roller 14*a* that makes pressure contact with the feed roller 13, and is configured to separate the sheets S fed out from the feed roller 13.

In the multiple-sheet feeding section 12 having such a structure, as the feed roller 13 as a sheet conveying rotary member rotates clockwise as illustrated in FIGS. 1 and 3 by being driven by a drive motor (not illustrated), the uppermost sheet S1 stacked on the sheet stacking plate 15*a* is delivered. After this, the uppermost sheet S1 is separated from other sheets by the sheet separation portion 14 and is conveyed to the downstream side.

The sheet S1 separated by the sheet separation portion 3*b* of the sheet feeding apparatus 3 or the sheet separation portion 14 of the multiple-sheet feeding section 12 is then conveyed to a transfer section including a photosensitive drum 6*a* and a transfer roller 6*b* through a pair of conveying rollers 4 and a pair of registration rollers 5. At this time, on a surface of the photosensitive drum 6*a*, toner images are formed by a laser beam output from a laser scanner 7 disposed above the photosensitive drum 6*a*. The toner images are then transferred onto the conveyed sheet S1 at the transfer section.

The sheet S1 having toner images transferred thereon is then conveyed on the downstream side. Then, the toner images are fused and fixed on the sheet S1 after being heated and pressurized by the fixing device 8. After that, thus processed sheets S are sequentially stacked on the discharge tray 11 through a sheet discharge unit such as the pair of conveying rollers 9 and the pair of discharge rollers 10.

Meanwhile, the sheet separation portion 3*b* of the sheet feeding apparatus 3 includes, as illustrated in FIG. 2, the separation roller 18 as the separation rotary member, a holding member 3*e*, a separation roller spring 3*g* as an urging member, and a guide member 3*f*. In the present embodiment, since the feed roller 3*a* also functions as a pickup roller, the separation roller 18 is positioned at a downstream side of a contact point between the feed roller 3*a* and the uppermost sheet S1.

In addition, the guide member 3*f* is fixed to the apparatus main body 1 and slidably holds the separation roller 18, the holding member 3*e*, and the separation roller spring 3*g*, which collectively form the sheet separation unit. The separation roller 18 is slidable in a vertical direction while being guided by a flat guide surface of the guide member 3*f*.

In the present embodiment, since the separation roller 18 is rotatably held on an upper end portion of the holding member 3*e* and is urged upward by the separation roller spring 3*g* along with the holding member 3*e*, the separation roller 18 makes pressure contact with the feed roller 3*a* so as to be slidable in a vertical direction.

In other words, the separation roller 18 is adapted to make pressure contact with the feed roller so as to be slidable in the vertical direction by the guide member 3*f* rather than being adapted to be slidable in a direction in which the feed roller 3*a* is opposed to the separation roller 18, that is, in a direction in which the separation roller 18 faces the center of the feed roller 3*a*. For this reason, the separation roller 18 is in pressure contact with the feed roller 3*a* at a predetermined angle with respect to the direction in which the separation roller 18 faces the center of the feed roller 3*a*. Then, by constructing the separation roller 18 so as to be slidable in the vertical direction as described above, the sheet separating portion 3*b* can be constructed within an area substantially equal to the width (diameter) of the separation roller 18.

Meanwhile, the sheet separation section 14 of the multiple-sheet feeding section 12 includes, as illustrated in FIG. 3, the separation roller 14*a*, a holding member 14*d*, a separation roller spring 14*c* as an urging member, and a guide member 14*e*. In the present embodiment, since the feed roller 13 also functions as a pickup roller, the separation roller 14*a* is positioned at a downstream side of a contact point between the feed roller 13 and the uppermost sheet S1.

In addition, the guide member 14*e* is fixed to the apparatus main body 1 and slidably holds the separation roller 14*a*, the holding member 14*d*, and the separation roller spring 14*c*, which collectively form the sheet separation unit. The separation roller 14*a* is slidable in a vertical direction while being guided by a flat guide surface of the guide member 14*e*.

In the present embodiment, since the separation roller 14*a* is rotatably held on an upper end portion of the holding member 14*d* and is urged upward by the separation roller spring 14*c* along with the holding member 14*d*, the separation roller 14*a* makes pressure contact with the feed roller 13 so as to be slidable in a vertical direction.

Referring to FIG. 3, the multiple-sheet feeding section 12 includes a multi-cover 15*c* that holds the sheet stacking plate 15*a* so as to be freely pivotable in a vertical direction, and a pressure spring 15*b* that urges the sheet stacking plate 15*a* from a back surface side (downside in FIG. 3) of the sheet stacking plate 15*a*. The sheet stacking plate 15*a* is pressed upward by the pressure spring 15*b* so that a leading end of the uppermost sheet S1 stacked on the sheet stacking plate 15*a* is pressed against the feed roller 13.

The driving force of a motor is not transmitted to the separation roller 18 of the sheet feeding apparatus 3, and the separation roller 18 is connected to a torque limiter 18A configured to suppress accompanied rotation of the separation roller 18 with the feed roller 13. In the present embodiment, a clamping torque limiter is used as the torque limiter 18A.

Figure 4A:
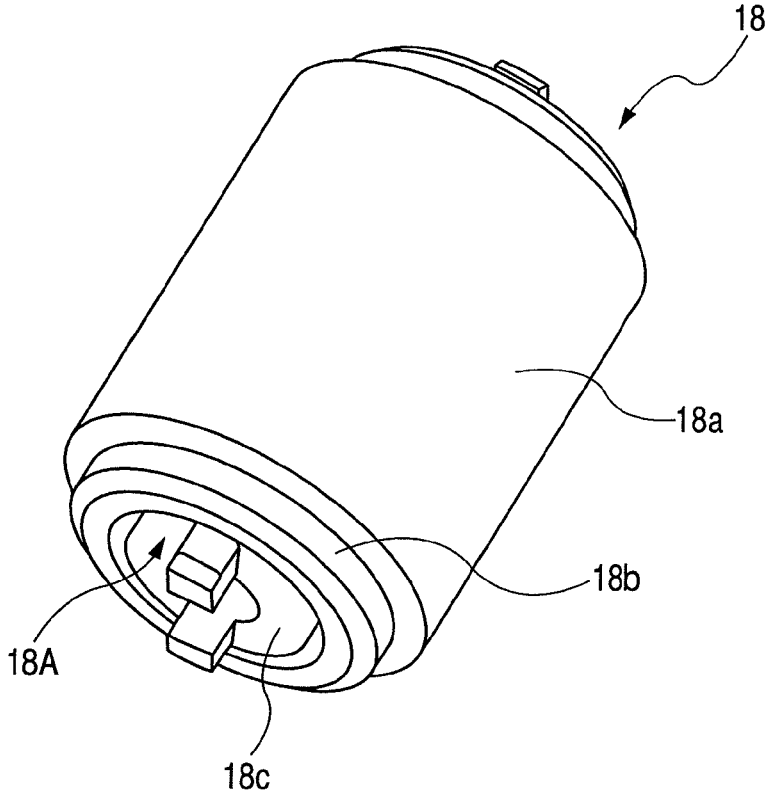
FIGS. 4A and 4B are diagrams illustrating the structure of a separation roller provided to the sheet feeding apparatus according to the first embodiment.
Figure 4B:
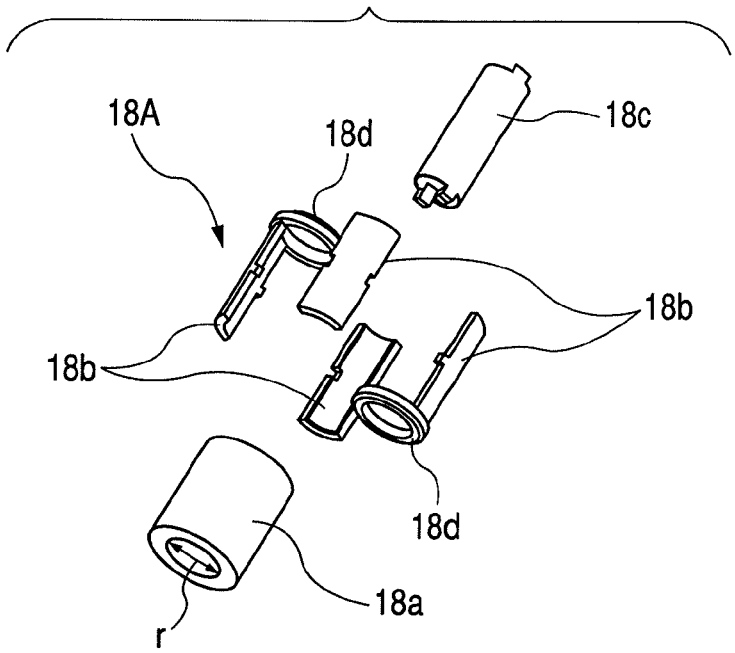

FIG. 4A is a perspective view of the separation roller 18 connected to the clamping torque limiter, and FIG. 4B is an exploded perspective view of the separation roller 18.

Referring to FIG. 4, the separation roller 18 includes a tubular roller main body 18*a* as an elastic member formed of rubber, and a columnar shaft member 18*c* made of metals of various kind or polymer materials. The separation roller 18 also includes a bearing-shaped sliding portion 18*b* that is divided into a plurality of pieces and adapted to surround the circumferential surface of the shaft member 18*c*. In the present embodiment, the sliding portion 18*b* is divided into four pieces. The roller main body 18*a* as the elastic member is fastened to the sliding portion 18*b* so as to cover the entire sliding portion 18*b*. In the present embodiment, the sheet conveying roller is formed by the roller main body 18*a* making contact with a conveyed sheet at an outer circumference thereof, the shaft member 18*c*, and the plurality of pieces of sliding portion 18*b* that is arranged in the circumferential direction of the shaft member 18*c*.

Among the four pieces of the sliding portion 18*b*, a blade guard portion 18*d* is formed at one end of each of two pieces of the sliding portion 18*b*. In the present embodiment, the sliding portion 18*b* is divided into four pieces, but the number of divided pieces is determined considering the magnitude of required torque and the size, material, shape, relative position, and other features of each component.

In the present embodiment, the torque limiter 18A is configured by the sliding portion 18*b* and the roller main body 18*a* configured to fasten the sliding portion 18*b* to the shaft member 18*c*. In the torque limiter 18A having such a structure, the accompanied rotation of the separation roller 18 with the feed roller 13 is suppressed by a frictional resistance generated by the clamping force of the roller main body 18*a* between the shaft member 18*c* and the sliding portion 18*b*.

In the torque limiter 18A, when the torque applied to the roller main body 18*a* is not greater than a predetermined torque, the sliding portion 18*b* and the roller main body 18*a* are not rotated relative to the shaft member 18*c* by the frictional resistance generated between the shaft member 18*c* and the sliding portion 18*b*. On the other hand, when the torque applied to the roller main body 18*a* is greater than the predetermined torque (rotation torque), the sliding portion 18*b* slides over the shaft member 18*c* so that the sliding portion 18*b* and the roller main body 18*a* are rotated relative to the shaft member 18*c*.

When only one sheet is pinched by the feed roller 13 and the separation roller 18, a large rotation torque is applied to the separation roller 18. Therefore, the sliding portion 18*b* slides over the shaft member 18*c*, and the roller main body 18*a* and the sliding portion 18*b* of the separation roller 18 are rotated following the rotation of the feed roller 13.

On the other hand, when plural sheets are pinched by the feed roller 13 and the separation roller 18, a relatively small rotation torque is applied to the separation roller 18. Therefore, the roller main body 18*a*, the sliding portion 18*b*, and the shaft member 18*c* are not moved at all by the frictional resistance generated between the shaft member 18*c* and the sliding portion 18*b*. That is, the accompanied rotation of the separation roller 18 with the feed roller 13 is suppressed. In this way, by suppressing the accompanied rotation of the separation roller 18 with the feed roller 13, the feed roller 13 can convey only one sheet at a time while the separation roller 18 prevents two or more sheets from being conveyed at the same time.

In the present embodiment, whether the frictional resistance generated between the shaft member 18*c* and the sliding portion 18*b* will cause the sliding portion 18*b* to slide on the shaft member 18*c* or not is determined in the following manner. That is, when a plurality of sheet is placed between the feed roller 13 and the separation roller 18, the sliding portion 18*b* is not allowed to slide on the shaft member 18*c*. On the other hand, when only one sheet is placed between the feed roller 13 and the separation roller 18, the sliding portion 18*b* is allowed to slide on the shaft member 18*c*.

Figure 5:
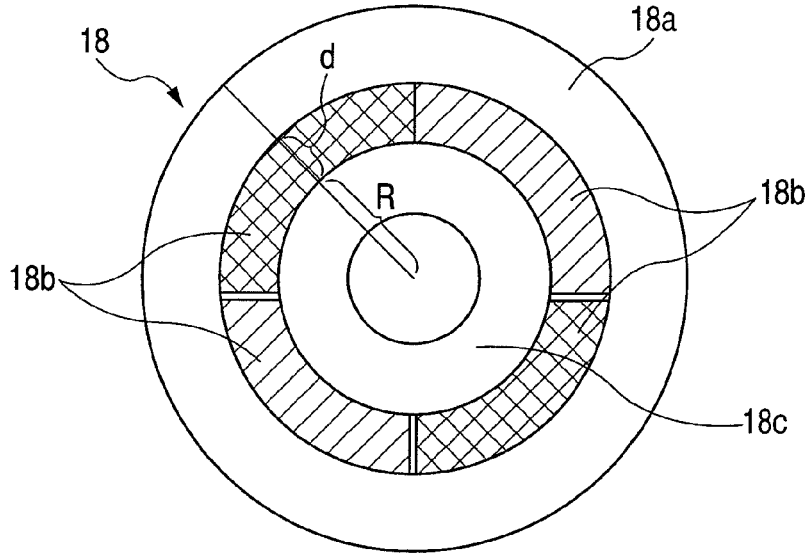
FIG. 5 is a sectional view of the separation roller provided to the sheet feeding apparatus according to the first embodiment.

In the present invention, as depicted in FIG. 5, the radius R of the shaft member 18*c*, the thickness d of the sliding portion 18*b*, and a free radius r of the roller main body 18*a* as depicted in FIG. 4 are set to satisfy the relationship of "R+d>r".

Therefore, when the sliding portion 18*b* is fastened to the roller main body 18*a* in a state that the circumferential surface of the shaft member 18*c* is surrounded by the sliding portion 18*b* separated into four pieces, the divided pieces of the sliding portion 18*b* are moved toward the shaft member 18*c* by the elastic force of the roller main body 18*a*. As a result, the shaft member 18*c* is clamped to the roller main body 18*a* through the sliding portion 18*b*.

By employing the elastic force of the roller main body 18*a* as such a clamping member, the torque limiter 18A can provide a desired function as a torque limiter without needing to have a special structure as a torque limiter mechanism.

Figure 6:
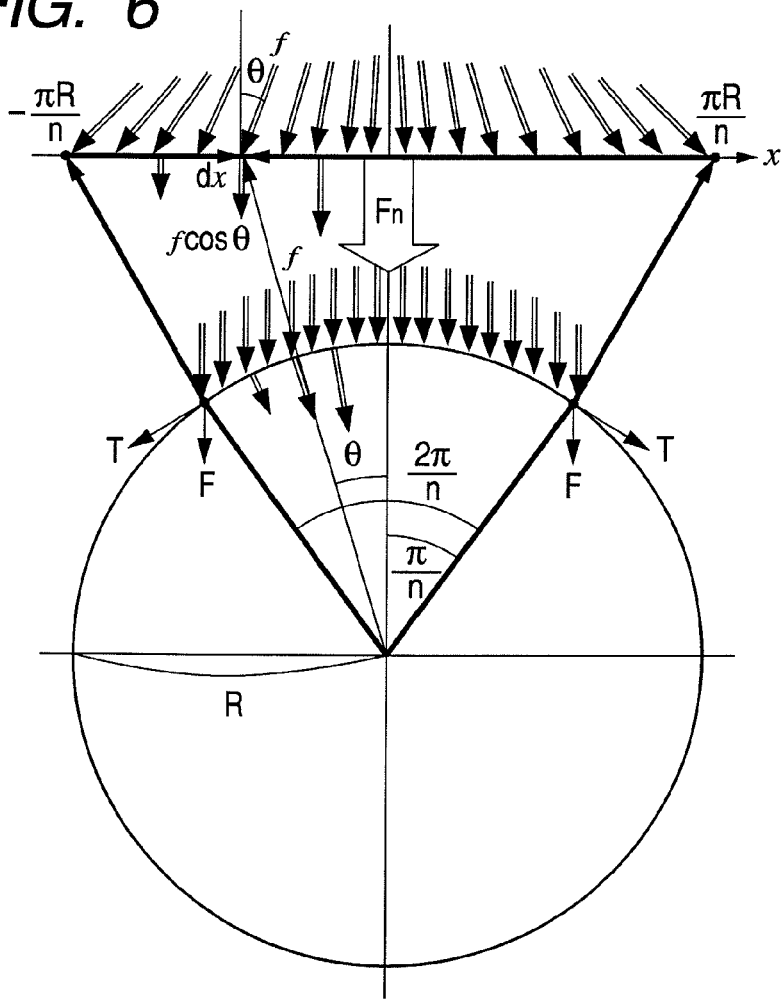
FIG. 6 is a diagram illustrating a calculation model used to derive a theoretical formula for calculation of the magnitude of a torque produced by a separation roller rubber of the separation roller.

A theoretical formula for calculation of the magnitude of the torque generated by the roller main body 18*a* can be derived from a calculation model as illustrated in FIG. 6. The calculation model illustrated in FIG. 6 shows a vector representation of a tension per unit area generated by the roller main body 18*a* as observed from the section illustrated in FIG. 5.

The tension T generated by the roller main body 18*a* is applied to both ends of the n-divided sliding portion 18*b* in a direction tangential to the surface of the shaft member 18*c*. Assuming the tension of the roller main body 18*a* has a spring constant of k, the tension T can be expressed by the following formula (1).

$$T=2\pi k(R+d-r) \tag{1}$$

The total force Fn of the tension T acting on the surface of the shaft member 18*c* via the n-divided sliding portion 18*b* can be expressed by the following formula (2).

$$F_n = 2T\cos\left(\frac{\pi}{2}-\frac{\pi}{n}\right) = 2T\sin\frac{\pi}{n} \tag{2}$$

Assuming a component force of the total force $F_n$ per unit area is f, the total force $F_n$ can be expressed by the following formula (3).

$$F_n = f \times \frac{2\pi}{n}R \tag{3}$$

From the formulas (2) and (3), the following formula (4) can be derived.

$$f = \frac{nT\sin(\pi/n)}{\pi R} \tag{4}$$

When the curved outer surface of the shaft member 18*c* receiving forces as illustrated in FIG. 6 is trans-positioned onto a plane, a normal force of the component force f acting on a very small distance dx can be expressed by the following formula (5).

$$f\cos\theta \tag{5}$$

From the formulas (4) and (5), the total normal force acting on the surface of the shaft member 18*c* as required for the torque calculation can be derived by the following formula (6).

$$\begin{aligned} F_n^{Vtcl} &= f \times \int_{-\pi R/n}^{\pi R/n} \cos\theta dx \\ &= \frac{nT\sin(\pi/n)}{\pi R}\int_{-\pi/n}^{\pi/n}\cos\theta d\theta \times R \end{aligned} \tag{6}$$

From the formulas (1) and (6), a torque $P_n$ generated by the tension T when the bearing-shaped sliding portion 18*b* is divided into n pieces can be derived by the following formula (7).

$$\begin{aligned} P_n = n\mu R F_n^{Vtcl} &= \frac{n^2\mu RT\sin(\pi/n)}{\pi}\int_{-\pi/n}^{\pi/n}\cos\theta d\theta \\ &= n^2\mu R \times 2k(R+d-r)\sin(\pi/n)\int_{-\pi/n}^{\pi/n}\cos\theta d\theta \\ &= 4\mu kR(R+d-r)n^2\sin^2\frac{\pi}{n} \end{aligned} \tag{7}$$

As described above, the torque limiter 18A according to the present embodiment employs the elastic force of the roller main body 18*a* having the circumferential surface in contact with a sheet as a clamping member. Therefore, the torque limiter 18A can provide a desired function as a torque limiter without needing to have a special structure only for a torque limiter mechanism. As a result, the separation roller 18 can be configured to have a minimal structure having a desired function without needing to have a special shape different from that of a typical separation roller.

Since the separation roller does not need to have a special shape different from that of a typical separation roller, a sheet conveying path that is symmetric in a longitudinal direction can be provided. As a result, sheet conveying operation can be performed in a stable manner while preventing the leading end of the sheet from being blocked midway in the sheet conveying path. As is obvious from the formula (7) that represents the magnitude of generated torque, the magnitude of generated torque is freely controllable by varying the number of divided pieces of the sliding portion 18*b*, the material and surface properties of the shaft member 18*c* and the sliding portion 18*b*, and the clamping force.

In other words, the magnitude of the frictional resistance generated between the shaft member 18*c* and the sliding portion 18*b* by the clamping force of the roller main body 18*a* is freely controllable by varying the number of divided pieces of the sliding portion 18*b*, the material and surface properties of the shaft member 18*c* and the sliding portion 18*b*, and the clamping force.

In the present embodiment, the roller main body 18*a* fastened to the sliding portion 18*b* in order to generate a braking torque is formed of rubber. However, the roller main body 18*a* may be formed of other members having elasticity such as elastomer or metal.

A second embodiment of the present invention will now be described.

Figure 7A:
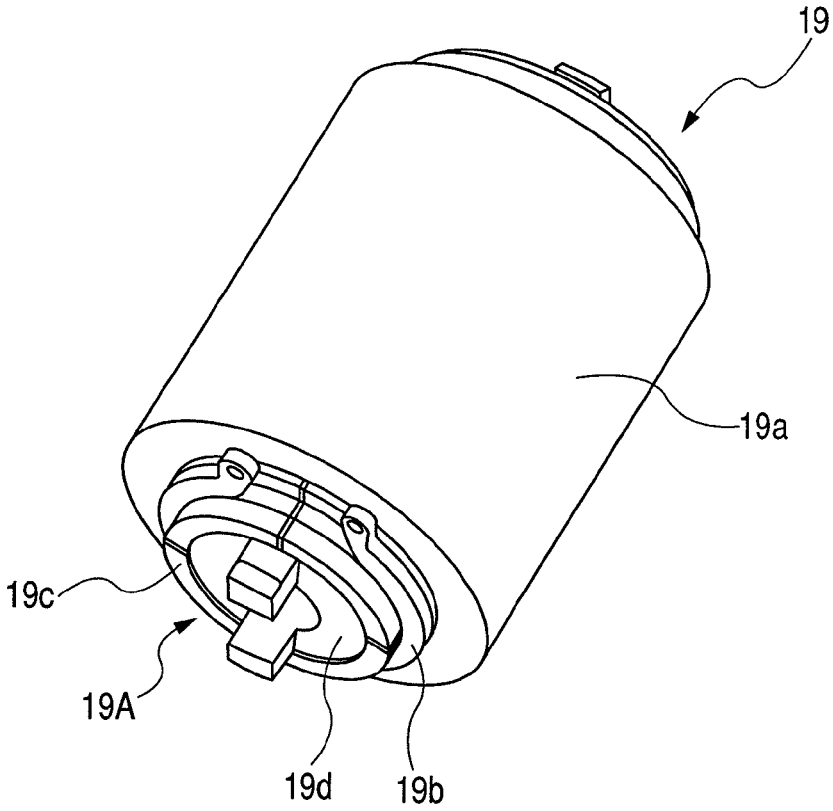
FIGS. 7A and 7B are diagrams illustrating the structure of a separation roller provided to a sheet feeding apparatus according to a second embodiment of the present invention.
Figure 7B:
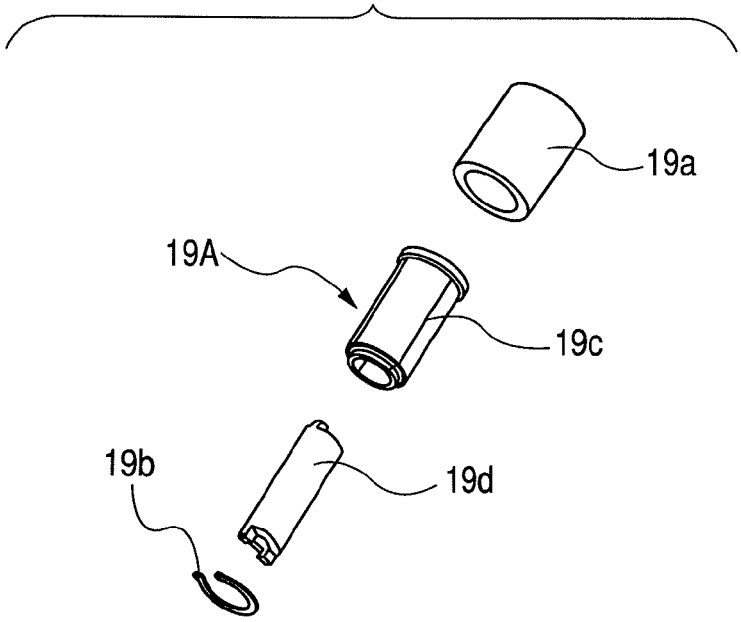
Figure 8:
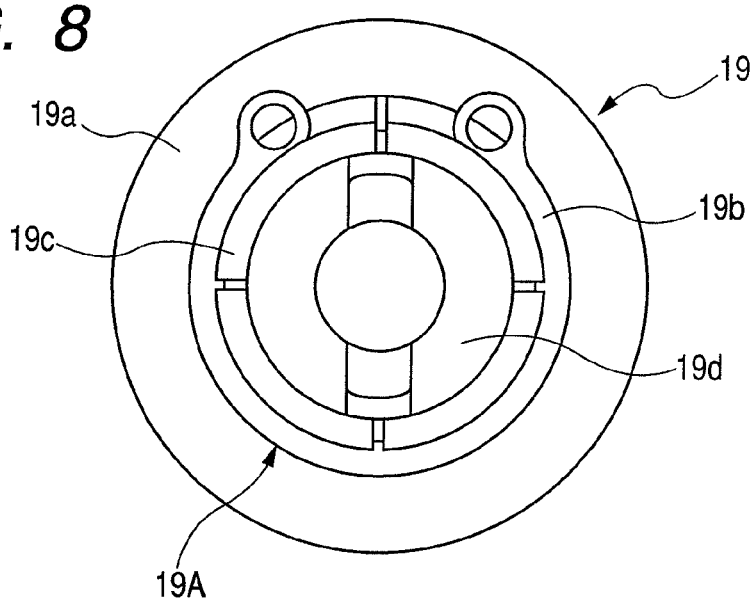
FIG. 8 is a front view of the separation roller provided to the sheet feeding apparatus according to the second embodiment.

FIGS. 7A and 7B are diagrams illustrating the structure of a separation roller provided to a sheet feeding apparatus according to the second embodiment, in which FIG. 7A is a perspective view of the separation roller, and FIG. 7B is an exploded perspective view thereof. FIG. 8 is a front view of the separation roller.

Referring to FIGS. 7 and 8, the separation roller 19 includes a torque limiter 19A that suppresses the accompanied rotation of the separation roller 19 with the feed roller 3*a*. The torque limiter 19A is configured by a bearing-shaped sliding portion 19*c* that is divided into a plurality of pieces and adapted to surround the circumferential surface of a shaft member 19*d* of the separation roller 19 and a grip ring 19*b* as an elastic member that is fastened to one end of the sliding part 19. The separation roller 19 also includes a tubular roller main body 19*a* as an elastic member formed of elastomer or metal and adapted to make close contact with the sliding portion 19*c*.

In the torque limiter 19A having such a structure, the grip ring 19*b* is fastened to the one end of the sliding portion 19*c* so that the shaft member 19*d* is clamped to the grip ring 19*b* through the sliding portion 19*c*, thereby generating a braking torque. At this time, the sliding portion 19*c* is also clamped to the shaft member 19*d* by the elastic force of the roller main body 19*a*.

With such a structure, the torque limiter 19A can generate a frictional resistance between the shaft member 19*d* and the sliding portion 19*c* by the clamping force of the grip ring 19*b* and the roller main body 19*a*. As a result, the accompanied rotation of the separation roller 19 with the feed roller 3*a* is suppressed.

As described above, the torque limiter 19A according to the present embodiment employs the elastic force of the grip ring 19*b* as well as the elastic force of the roller main body 19*a* as a clamping member. Therefore, the torque limiter 19A can provide a desired function as a torque limiter without needing to have a special structure as a torque limiter mechanism. As a result, the separation roller 19 can be configured to have a minimal structure having a desired function without needing to have a special shape different from that of a typical separation roller.

In the present invention, the sheet feeding apparatus is described to have the feed roller 3*a* also functioning as a pickup roller. However, the present invention is not limited to this. For example, as illustrated in FIG. 9, the sheet feeding apparatus may be provided with a separate pickup roller 3*h* in addition to the feed roller 3*a*.

In such a sheet feeding apparatus having the separate pickup roller 3*h*, the pickup roller 3*h* delivers the sheets S stacked on the sheet stacking plate 2*a* and are then feed out while being separated one by one by the feed roller 3*a* and the separation roller 18.

In the present invention, when bringing the separation roller 18 into pressure contact with the feed roller 3*a*, the separation roller 18 is urged by the separation roller spring 3*g* along with the holding member 3*e*. However, the present invention is not limited to this.

Figure 10A:
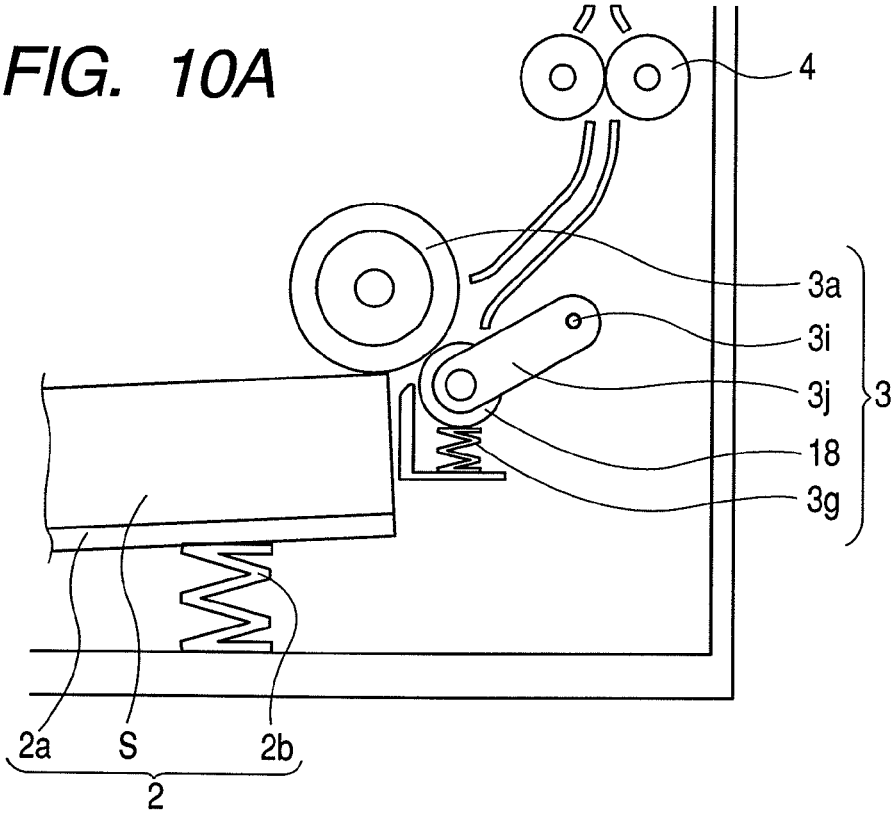
FIGS. 10A and 10B are diagrams illustrating the structure of the sheet feeding apparatus according to a second modification.
Figure 10B:
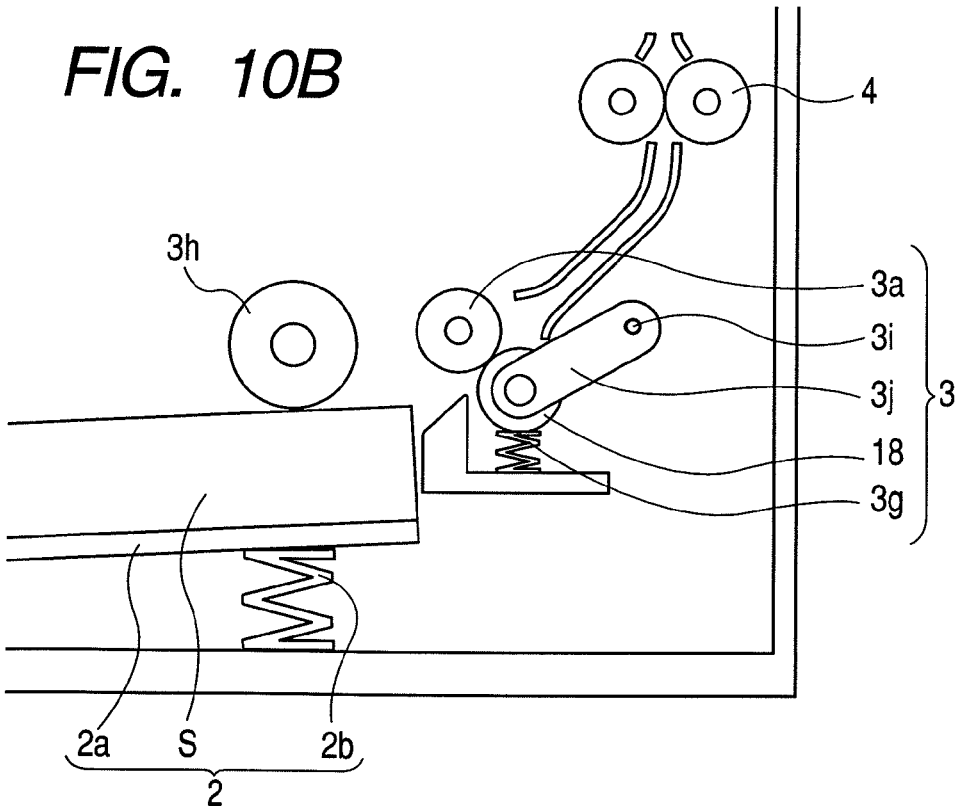
Figure 11:
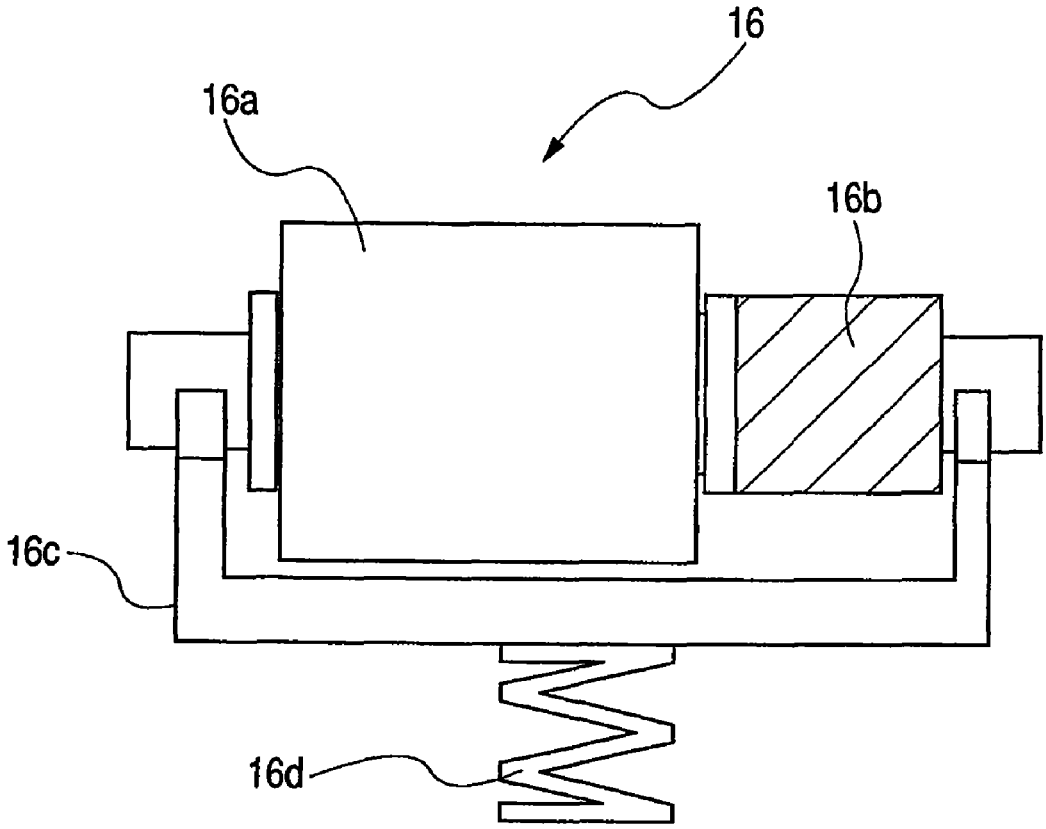
FIG. 11 PRIOR ART
FIG. 11 is a diagram of a first example of a conventional separation roller having a torque limiter.
Figure 12A:
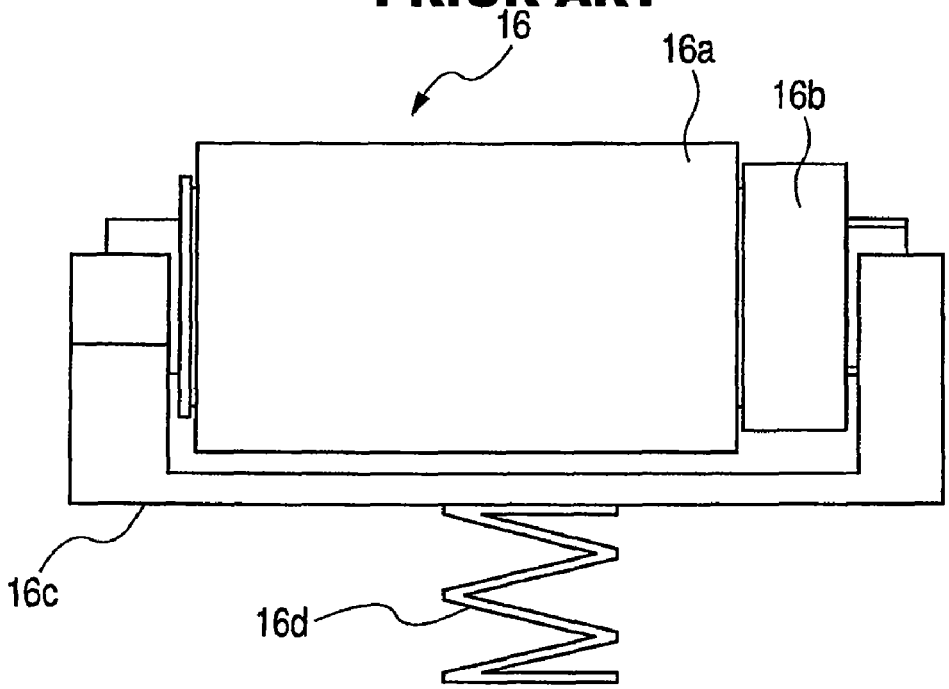
FIG. 12A PRIOR ART
FIGS. 12A and 12B are diagrams of a second example of a conventional separation roller having a torque limiter.
Figure 12B:
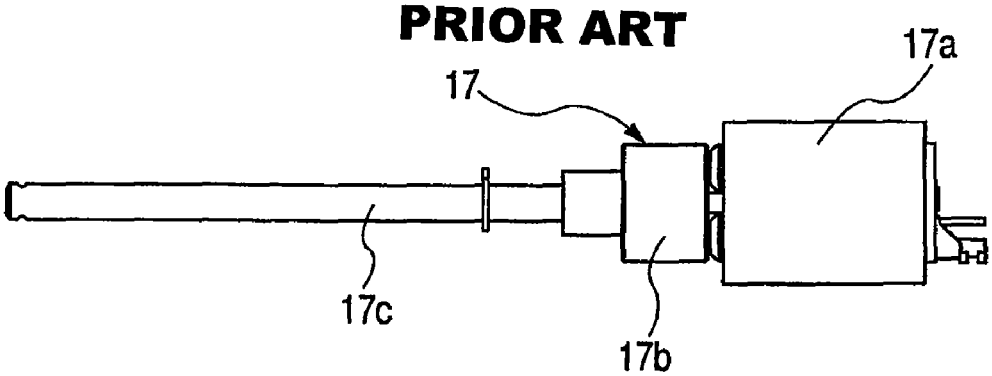
FIG. 12B PRIOR ART

For example, as illustrated in FIG. 10A, the sheet feeding apparatus may be constructed such that the separation roller 18 is provided at a pivoting end of an arm 3*j* that can freely pivot about a spindle 3*i*, and the arm 3*j* is urged by the separation roller spring 3*g* so as to move the separation roller 18 in a vertical direction. In addition, as illustrated in FIG. 10B, the sheet feeding apparatus may be constructed such that the sheets S stacked on the sheet stacking plate 2*a* are delivered by the pickup roller 3*h*, the separation roller 18 is provided at a pivoting end of an arm 3*j* that can freely pivot about a spindle 3*i*, and the arm 3*j* is urged by the separation roller spring 3*g* so as to move the separation roller 18 in a vertical direction.

In the present invention, the shaft member 18*c* of the separation roller 18 is described to be unable to rotate. However, the shaft member 18*c* of the separation roller 18 may be adapted to be rotatable in a direction opposite to the direction for feeding sheets.

In the present invention, the sheet feeding apparatus is described to be provided to an image forming apparatus. However, the present invention may be applied to an automatic document feeding apparatus that is provided to an image reading apparatus so as to convey documents to an image reading section.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-327527, filed Dec. 4, 2006, which is hereby incorporated by reference herein in its entirety.

What is claimed is:

1. A sheet conveying roller, comprising:

a shaft member;

a plurality of sliding parts provided in a circumferential direction of said shaft member so as to surround a circumferential surface of said shaft member, said plurality of sliding parts being adapted to make sliding contact with said shaft member;

a hollow-shaped elastic member whose inside surface contacts said plurality of sliding parts and outside surface contacts a conveyed sheet, said hollow-shaped elastic member fastens said plurality of sliding parts to said shaft member by elastic force of said hollow-shaped elastic member, wherein a frictional resistance is generated between said shaft member and said plurality of sliding parts by the elastic force of said hollow-shaped elastic member.

2. A sheet conveying roller according to claim 1, further comprising a ring adapted to clamp said plurality of sliding parts, wherein said ring complementarily generates an additional frictional resistance into the frictional resistance between the shaft member and said plurality of sliding parts.

3. A sheet conveying roller according to claim 1, wherein when a torque acting on the outer circumference of said hollow-shaped elastic member is greater than a predetermined torque, said plurality of sliding parts slides on said shaft member so that said plurality of sliding parts and said hollow-shaped elastic member are rotated relative to said shaft member.

4. A sheet feeding apparatus, comprising:

a sheet stacking portion on which sheets are stacked;

a sheet conveying rotary member that conveys the sheets stacked on the sheet stacking portion;

a shaft member;

a plurality of sliding parts provided in a circumferential direction of said shaft member so as to surround a circumferential surface of said shaft member, said plurality of sliding parts being adapted to make sliding contact with said shaft member;

a separation rotary member formed of a hollow-shaped elastic member whose outside surface contacts a conveyed sheet so as to separate plural sheets in cooperation with said sheet conveying rotary member and whose inside surface contacts said plurality of sliding parts, said separation rotary member fastens said plurality of sliding parts to said shaft member by elastic force of said separation rotary member, wherein a frictional resistance is generated between said shaft member and said plurality of sliding parts by the elastic force of said separation rotary member formed of said hollow-shaped elastic member.

5. A sheet feeding apparatus according to claim 4, wherein when a plurality of sheets are nipped by said sheet conveying rotary member and said separation rotary member, said separation rotary member is not rotated relative to said shaft member by the frictional force between said shaft member and said plurality of sliding parts, and wherein when only one sheet is nipped by said sheet conveying rotary member and said separation rotary member, said plurality of sliding parts is slid over said shaft member by the rotation of said sheet conveying rotary member so that said separation rotary member is rotated relative to said shaft member.

* * * * *